US008249750B2

(12) United States Patent
Sakae et al.

(10) Patent No.: US 8,249,750 B2
(45) Date of Patent: Aug. 21, 2012

(54) AIR CONDITIONER

(75) Inventors: Norio Sakae, Kusatsu (JP); Junichi Hirose, Kusatsu (JP); Masahiro Tanaka, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 12/938,131

(22) Filed: Nov. 2, 2010

(65) Prior Publication Data

US 2011/0046791 A1 Feb. 24, 2011

Related U.S. Application Data

(62) Division of application No. 11/791,698, filed as application No. PCT/JP2005/021366 on Nov. 21, 2005, now Pat. No. 7,848,852.

(30) Foreign Application Priority Data

Nov. 29, 2004 (JP) ..... 2004-343573

(51) Int. Cl.
*F24F 11/02* (2006.01)
*G05D 23/00* (2006.01)

(52) U.S. Cl. ..... 700/276; 324/511; 236/51

(58) Field of Classification Search ..... 700/276; 324/511, 543; 236/51; 62/175
See application file for complete search history.

(56) References Cited

U.S. PATENT DOCUMENTS

| | | | | |
|---|---|---|---|---|
| 5,642,857 | A | 7/1997 | Totsuka et al. | |
| 6,777,954 | B2 * | 8/2004 | Yamada et al. | 324/543 |
| 2005/0067900 | A1 | 3/2005 | Bailey | |

FOREIGN PATENT DOCUMENTS

| | | | |
|---|---|---|---|
| EP | 1036995 | | 9/2000 |
| EP | 1158253 | | 11/2001 |
| JP | 6-257836 | A | 9/1994 |
| JP | 7-133950 | A | 5/1995 |
| JP | 8-271022 | A | 10/1996 |
| JP | 2000-111123 | A | 4/2000 |

* cited by examiner

*Primary Examiner* — John Cottingham
*Assistant Examiner* — Steven Garland
(74) *Attorney, Agent, or Firm* — Birch, Stewart, Kolasch & Birch, LLP.

(57) ABSTRACT

An indoor unit includes an indoor side switch device which is brought into a closed state at a startup time when operation starts from a standby state. An outdoor unit includes a startup power supply switch device which is brought into a closed state when the indoor side switch device of the indoor unit is brought into the closed state, an operating power supply switch device which is brought into a closed state in operation and is brought into an open state in the standby state, and an outdoor control device. The outdoor control device of the outdoor unit brings the startup power supply switch device into the open state when the operation starts from the standby state and thereafter brings the operating power supply switch device into the closed state after a lapse of a prescribed time.

2 Claims, 11 Drawing Sheets

AIR CONDITIONER

This application is a Divisional of application Ser. No. 11/791,698, filed on May 25, 2007 now U.S. Pat. No. 7,848,852, the entire contents of which are hereby incorporated by reference and for which priority is claimed under 35 U.S.C. §120.

TECHNICAL FIELD

The present invention relates to an air conditioner having an indoor unit and an outdoor unit connected via connection wiring.

BACKGROUND ART

Conventionally, there has been proposed an air conditioner, which is externally supplied with a power by an outdoor unit and able to reduce the power consumption in a standby state of an indoor unit and the outdoor unit by limiting the supply of a main power to each part via a power line in the standby state (refer to, for example, JP 2000-111123 A). The air conditioner includes the indoor unit, the outdoor unit and a signal line for transmitting and receiving a transmission signal between the indoor unit and the outdoor unit.

Since the transmission of the transmission signal via the signal line has been performed by an AC power in the conventional air conditioner, its transmission speed depends on the frequency and tends to have difficulties in being increased in speed. On the other hand, it has been concerned that, when a power supply is newly provided to increase the speed of the transmission of the transmission signal via the signal line, the power consumptions in the standby state of the indoor unit and the outdoor unit be increased due to the provision of the power supply.

Accordingly, in order to solve such a problem, the present applicant has proposed an air conditioner and a control method capable of transmitting the transmission signal at high speed and reducing the power consumption in the standby state of the indoor unit and the outdoor unit. It is noted that the air conditioner and the control method are intended for easy understanding of the present invention and neither a known art nor a prior art.

In the air conditioner, a relay is provided between one of power lines that connect the indoor unit with the outdoor unit and the signal line, and an operating power supply relay of the outdoor unit is turned on by transmitting a power for startup to the outdoor unit using the signal line by turning on the relay for a prescribed time when the operation starts from the standby state in which the power of the outdoor unit is cut off.

However, it is sometimes the case where, when the connection wires are miswired by mistake in connecting the indoor unit with the outdoor unit by connection wiring lines in the air conditioner, a closed circuit including a power source is formed between a part on the indoor unit side and a part on the outdoor unit side, and this disadvantageously leads to the damage of components.

DISCLOSURE OF THE INVENTION

Accordingly, it is an object of the present invention to provide an air conditioner capable of preventing the damage of components with a simple construction even when the operation starts in a state in which the connection wiring lines that connect the indoor unit with the outdoor unit are miswired.

In order to achieve the above object, an air conditioner according to the first inventive aspect comprises:

an indoor unit and an outdoor unit which are connected via connection wiring;

the connection wiring comprising two power lines for supplying a power from an external power source to the indoor unit via the outdoor unit, and one signal line for carrying out communication between the indoor unit and the outdoor unit;

the indoor unit comprising an indoor side transmitting and receiving means which is connected to the signal line and employs a photocoupler, an indoor side switch means which is connected between one of the power lines and the signal line and brought into a closed state at a startup time when operation starts from a standby state in which the supply of power of the outdoor unit is stopped, and an indoor control means which controls the indoor side switch means; and the outdoor unit comprising an outdoor side transmitting and receiving means which is connected to the signal line and employs a photocoupler, and a load which is supplied with a power from the two power lines of the connection wiring, wherein the indoor control means of the indoor unit does not bring the indoor side switch means into the closed state upon determining that the connection wiring lines which connect the indoor unit with the outdoor unit are miswired on the basis of a reception output of the indoor side transmitting and receiving means when the operation starts from the standby state.

For example, in a case where the connection wiring lines are connected partially exchanged by connecting the terminal to which the signal line of the indoor unit should be connected with the terminal to which the other of the power lines of the outdoor unit should be connected and connecting the terminal to which the signal line of the outdoor unit should be connected with the terminal to which the other of the power lines of the indoor unit should be connected, a closed circuit is formed of part of the indoor unit, part of the outdoor unit and the power source via the indoor side switch means when the indoor side switch means is directly brought into the closed state at the startup time when the operation starts from the standby state in which the power supply of the outdoor unit is stopped, and an overcurrent flows through the circuit, disadvantageously damaging the components. In contrast to this, according to the air conditioner of the above construction, the indoor control means of the indoor unit determines that the connection wiring lines which connect the indoor unit with the outdoor unit are miswired on the basis of the reception output of the indoor side transmitting and receiving means when the operation starts from the standby state in the miswired state as described above. That is, in the case of the miswiring as described above, it becomes possible to determine that the connection wiring lines are miswired before the indoor side switch means is brought into the closed state by applying the power voltage to the signal line to turn on the reception output of the indoor side transmitting and receiving means. Therefore, even if the operation starts in the state in which the connection wiring lines that connect the indoor unit with the outdoor unit are miswired, the damage of components can be prevented with a simple construction employing the indoor side transmitting and receiving means.

In the air conditioner of one embodiment, the indoor control means of the indoor unit determines that the connection wiring lines which connect the indoor unit with the outdoor unit are miswired when the reception output of the indoor side transmitting and receiving means is turned on at the time of starting the operation from the standby state in which the supply of power of the outdoor unit is stopped.

According to the air conditioner of the above embodiment, it becomes possible to easily determine that the connection wiring lines are miswired before the indoor side switch means is brought into the closed state by applying the power voltage to the signal line to turn on the reception output of the indoor side transmitting and receiving means in the miswired state as described above.

In the air conditioner of one embodiment, the indoor unit comprises an informing means for informing a user of miswiring, and the indoor control means informs the user of miswiring by the informing means upon determining that the connection wiring lines which connect the indoor unit with the outdoor unit are miswired.

According to the air conditioner of the above embodiment, the informing means informs the user of the miswiring upon determining that the connection wiring lines are miswired. Therefore, the operator is able to perceive the cause of the trouble at the time of installation and to swiftly cope with the trouble.

In order to achieve the above object, an air conditioner according to the second inventive aspect comprises:

an indoor unit and an outdoor unit which are connected via connection wiring;

the connection wiring comprising two power lines for supplying a power from an external power source via one of the indoor unit and the outdoor unit to the other of the indoor unit and the outdoor unit, and one signal line for carrying out communication between the indoor unit and the outdoor unit;

the indoor unit comprising an indoor side switch means which is connected between one of the power lines and the signal line and brought into a closed state at a startup time when operation starts from a standby state in which the supply of power of the outdoor unit is stopped, and the outdoor unit comprising a startup power supply switch means which is brought into a closed state so that a power for startup is supplied from the indoor unit side via the signal line when the indoor side switch means of the indoor unit is brought into the closed state, an operating power supply switch means which is brought into a closed state so that the power for operation is supplied to a load via the power line in operation while is brought into an open state in the standby state, and an outdoor control means which controls the operating power supply switch means (MRM10) and the startup power supply switch means, wherein the outdoor control means of the outdoor unit brings the startup power supply switch means into the closed state when the operation starts from the standby state by supplying a power for startup from the indoor unit side via the signal line and the startup power supply switch means as a consequence that the indoor side switch means of the indoor unit is brought into the closed state and thereafter brings the operating power supply switch means into the closed state after a lapse of a prescribed time.

For example, in a case where the connection wiring lines are connected partially exchanged by connecting the terminal to which the signal line of the indoor unit should be connected with the terminal to which the other of the power lines of the outdoor unit should be connected and connecting the terminal to which the signal line of the outdoor unit should be connected with the terminal to which the other of the power lines of the indoor unit should be connected, a closed circuit is formed of part of the indoor unit, part of the outdoor unit (including the operating power supply switch means and the startup power supply switch means) and the power source via the indoor side switch means when the indoor side switch means is directly brought into the closed state at the startup time when the operation starts from the standby state in which the power supply of the outdoor unit is stopped, and an overcurrent flows through the circuit, disadvantageously damaging the components. In contrast to this, according to the air conditioner of the above construction, the operating power supply switch means is brought into the closed state after a lapse of the prescribed time after the startup power supply switch means is brought into the open state by the outdoor control means of the outdoor unit when the operation starts from the standby state by supplying the power for the startup from the indoor unit side to the outdoor unit side via the indoor side switch means and the signal line as a consequence that the indoor side switch means of the indoor unit is brought into the closed state. That is, by bringing the startup power supply switch means into the open state before the operating power supply switch means is brought into the closed state, no closed circuit is formed of part of the indoor unit and part of the outdoor unit via the indoor side switch means. Therefore, even when the operation starts in the state in which the connection wiring lines that connect the indoor unit with the outdoor unit are miswired, damage of the components can be prevented with a simple construction.

In the air conditioner of one embodiment, the indoor unit comprises an indoor side transmitting and receiving means connected to the signal line; an indoor control means which controls the indoor side switch means and the indoor side transmitting and receiving means, and an informing means for informing a user of miswiring, the outdoor unit comprises an outdoor side transmitting and receiving means which is connected to the signal line and carries out communication with the indoor side transmitting and receiving means, and the indoor control means determines that the connection wiring lines which connect the indoor unit with the outdoor unit are miswired when no communication with the outdoor side transmitting and receiving means can be achieved by the indoor side transmitting and receiving means after bringing the indoor side switch means (MR10) into the closed state to start operation from the standby state and informs the user of miswiring by the informing means.

According to the air conditioner of the above embodiment, when no communication with the outdoor side transmitting and receiving means can be achieved by the indoor side transmitting and receiving means after the indoor side switch means is brought into the closed state, the indoor control means determines that the connection wiring lines are miswired and informs the user of the miswiring by the informing means. Therefore, the operator is able to perceive the cause of the trouble at the time of installation and to swiftly cope with the trouble.

As is apparent from the above, according to the air conditioner of the first inventive aspect, the indoor control means of the indoor unit determines that the connection wiring lines which connect the indoor unit with the outdoor unit are miswired on the basis of the reception output of the indoor side transmitting and receiving means when the operation starts from the standby state in the miswired state and does not bring the indoor side switch means into the closed state. With this arrangement, damage of the components can be prevented with a simple construction even when the operation starts in the miswiring state in which the connection wiring lines which connect the indoor unit with the outdoor unit are miswired.

Moreover, according to the air conditioner of the above embodiment, it becomes possible to easily determine that the connection wiring lines are miswired before the indoor side switch means is brought into the closed state by applying the power voltage to the signal line to turn on the reception output of the indoor side transmitting and receiving means in the miswired state as described above.

Moreover, according to the air conditioner of one embodiment, by informing the user of the miswiring by the informing means when the indoor control means determines that the connection wiring lines are miswired, the operator is able to perceive the cause of the trouble at the time of installation and to swiftly cope with the trouble.

Moreover, according to the air conditioner of the second inventive aspect, the operating power supply switch means is brought into the closed state after a lapse of the prescribed time after the startup power supply switch means is brought into the open state by the outdoor control means of the outdoor unit when the operation starts from the standby state by supplying the power for the startup from the indoor unit side to the outdoor unit side via the indoor side switch means and the signal line as a consequence that the indoor side switch means of the indoor unit is brought into the closed state. Therefore, even when the operation starts in the state in which the connection wiring lines that connect the indoor unit with the outdoor unit are miswired, damage of the components can be prevented with a simple construction.

Moreover, according to the air conditioner of one embodiment, when no communication with the outdoor side transmitting and receiving means can be achieved by the indoor side transmitting and receiving means after the indoor side switch means is brought into the closed state, the indoor control means determines that the connection wiring lines are miswired and informs the user of the miswiring by the informing means. With this arrangement, the operator is able to perceive the cause of the trouble at the time of installation and to swiftly cope with the trouble.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
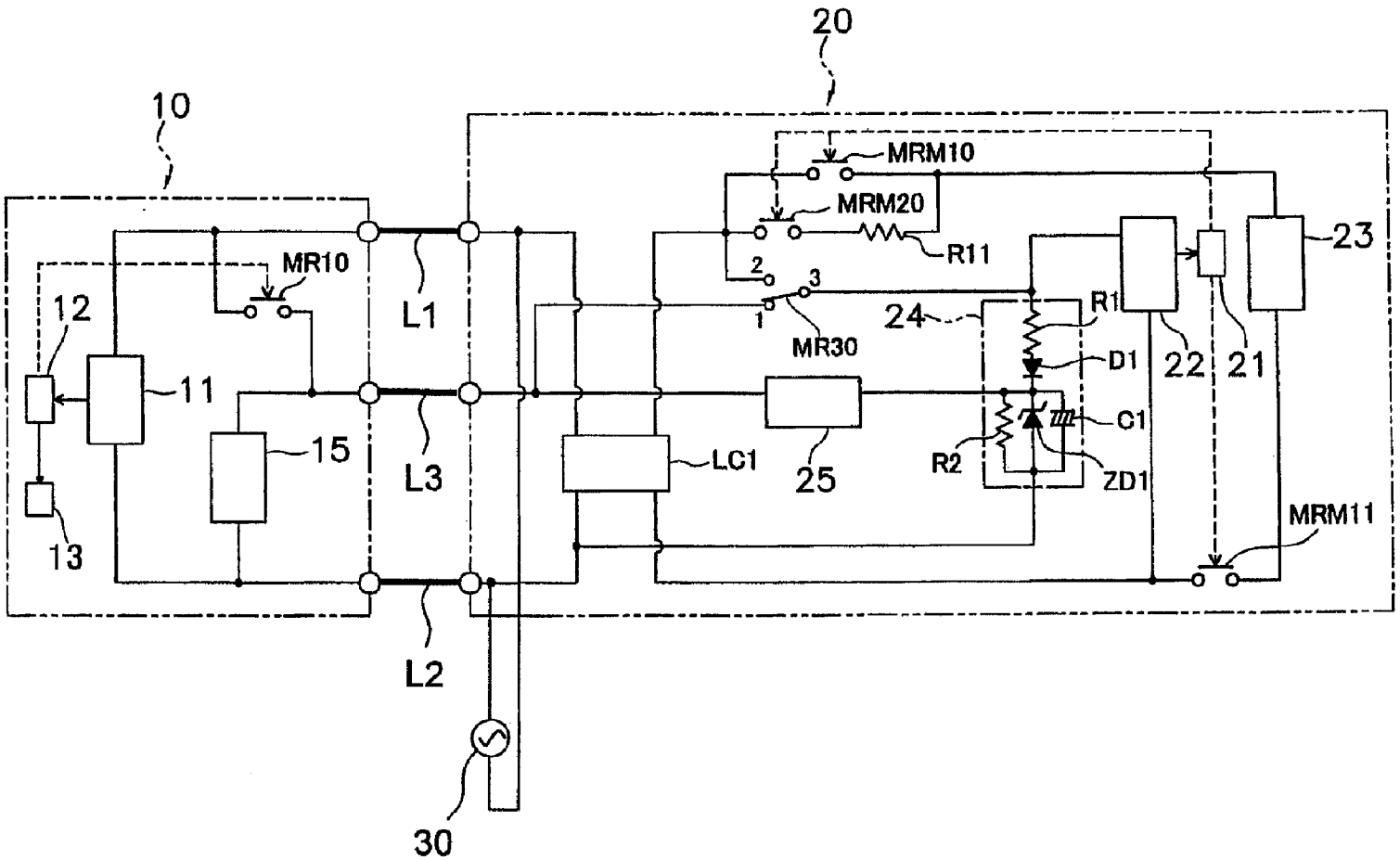
FIG. 1 is a block diagram of an air conditioner according to a first embodiment of the present invention.

The air conditioner of the present invention will now be described in detail below by the embodiments shown in the drawings.

(First Embodiment)

FIG. 1 is a block diagram of the air conditioner of the first embodiment of the present invention, showing an indoor unit 10, an outdoor unit 20 connected to the indoor unit 10 via connection wiring lines (L1 through L3), and an external power source 30 connected to the outdoor unit 20.

The indoor unit 10 includes a power circuit 11 that has one terminal connected to the power line L1 and has the other terminal connected to the power line L2, an indoor side transmitting and receiving section 15 as one example of the indoor side transmitting and receiving means that has one terminal connected to one terminal of the signal line L3 and has the other terminal connected to the power line L2, and a relay MR10 as one example of the indoor side switch means connected between the power line L1 and the signal line L3, the relay MR10 being normally in an open state. The indoor unit 10 also includes an indoor control section 12 as one example of the indoor control means that is supplied with a power from the power circuit 11 and controls the relay MR10 and so on, and a display section 13 as one example of the informing means controlled by the indoor control section 12. A power voltage supplied from the external power source 30 is applied across both terminals of the power circuit 11 via the power lines L1 and L2.

On the other hand, the outdoor unit 20 includes an EMI filter LC1 that have input terminals (T1 and T2 shown in FIG. 4) connected to the power lines L1 and L2, an outdoor side transmitting and receiving section 25 as one example of the outdoor side transmitting and receiving means connected to the other terminal of the signal line L3, a transmission power circuit 24 that has one terminal connected to the signal line L3 via a switchover relay MR30 and supplies a power to the outdoor side transmitting and receiving section 25, a switching power circuit 22 that has one terminal connected to the signal line L3 via the switchover relay MR30, and a power circuit 23 as one example of the load that has one terminal connected via a relay MRM10 to one terminal (T3 shown in FIG. 4) of the output terminals of the EMI filter LC1. The other terminal of the switching power circuit 22 is connected to the other terminal (T4 shown in FIG. 4) of the output terminals of the EMI filter LC1, and the other terminal of the power circuit 23 is connected to the other terminal of the output terminals of the EMI filter LC1 via a relay MRM11. Moreover, a relay MRM20 and a resistor R11 are connected to both terminals of the relay MRM10 serially in order from the EMI filter LC1 side. The outdoor unit 20 also includes an outdoor control section 21 as one example of the outdoor control means that is supplied with a power from the switching power circuit 22 and controls the relays MRM10, MRM20, MRM11, MR30 and so on. The resistor R11 prevents an overcurrent from flowing through the relay MRM11 and the relay MRM20 when power supply starts from the standby state.

The switchover relay MR30 has input terminals 1 and 2 and an output terminal 3. The input terminal 1 is connected to the signal line L3, the input terminal 2 is connected to one terminal (T3 shown in FIG. 4) of the output terminals of the EMI filter LC1, and the output terminal 3 is connected to one terminal of the switching power circuit 22. The switchover relay MR30, which connects the signal line L3 with the transmission power circuit 24 in the OFF state, releases the connection between the signal line L3 and the transmission power circuit 24 in the ON state and connects one (T3 shown in FIG. 4) of the output terminals of the EMI filter LC1 with the transmission power circuit 24.

The transmission power circuit 24 has a resistor R1 that has one terminal connected to the signal line L3 via a switchover relay MRM30, a diode D1 of which the anode is connected to the other terminal of the resistor R1, a zener diode ZD1 of which the cathode is connected to the cathode of diode D1 and the anode is connected to the power line L2, a smoothing capacitor C1 connected in parallel with the zener diode ZD1, and a resistor R2 connected in parallel with the zener diode ZD1. The resistor R2 prevents an overvoltage from being applied across both terminals of the zener diode ZD1 and the smoothing capacitor C1.

An AC voltage supplied from the power lines L1 and L2 shown in FIG. 1 is half-wave rectified by the diode D1 and smoothed by a smoothing capacitor C1. The smoothed DC voltage is regulated to a constant voltage by the zener diode ZD1 and supplied to the outdoor side transmitting and receiving section 25.

Figure 2:
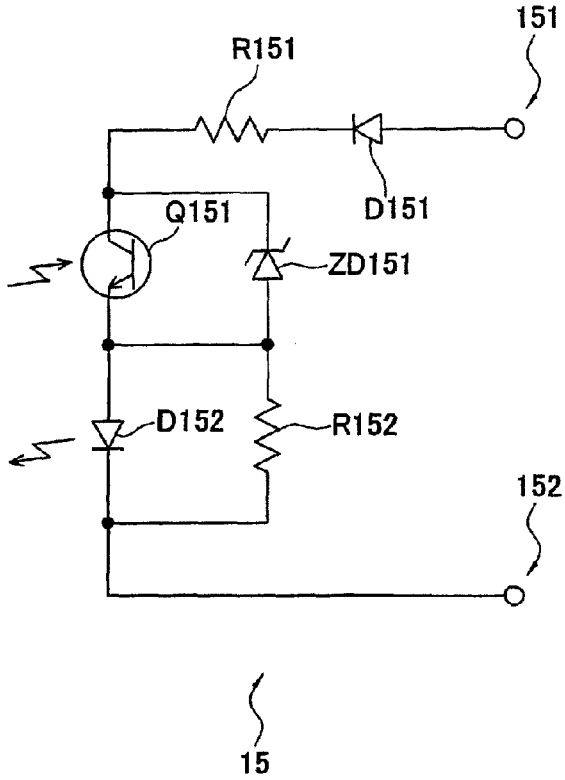
FIG. 2 is a circuit diagram of an indoor side transmitting and receiving section of the air conditioner.

FIG. 2 shows a circuit diagram of the indoor side transmitting and receiving section 15. As shown in FIG. 2, the indoor side transmitting and receiving section 15 includes a diode D151 of which the anode is connected to a terminal 151, a resistor R151 that has one terminal connected to the cathode of the diode D151, a phototransistor Q151 of which the collector is connected to the other terminal of the resistor R151, a light-emitting diode D152 of which the anode is connected to the emitter of the phototransistor Q151 and the cathode is connected to a terminal 152, a zener diode ZD151 of which the cathode is connected to the collector of the phototransistor Q151 and the anode is connected to the emitter of the phototransistor, and a resistor R152 connected in parallel with both terminals of the light-emitting diode D152. Moreover, in the indoor side transmitting and receiving section 15, a photocoupler is constructed of a pair of the phototransistor Q151 and a light-emitting diode (not shown), and a photocoupler is constructed of a pair of the light-emitting diode D152 and a phototransistor (not shown), enabling two-way communications. The terminal 151 of the indoor side transmitting and receiving section 15 is connected to the communication line L3, and the terminal 152 is connected to the power line L2.

The resistor R151 limits the current that flows through the phototransistor Q151 and the light-emitting diode D152, and the diode D151 prevents the current from flowing backward. The zener diode ZD151 prevents an overvoltage from being applied across both terminals of the phototransistor Q151, and the resistor R152 prevents an overvoltage from being applied across both terminals of the light-emitting diode D152.

Figure 3:
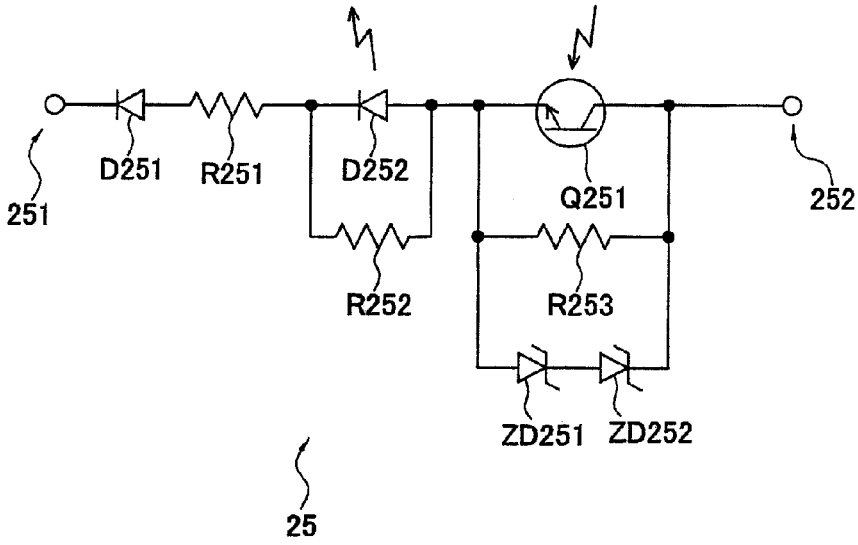
FIG. 3 is a circuit diagram of an outdoor side transmitting and receiving section of the air conditioner.

FIG. 3 shows a circuit diagram of the outdoor side transmitting and receiving section 25. As shown in FIG. 3, the outdoor side transmitting and receiving section 25 includes a diode D251 of which the cathode is connected to a terminal 251, a resistor R251 that has one terminal connected to the anode of the diode D251, a light-emitting diode D252 of which the cathode is connected to the other terminal of the resistor R251, a resistor R252 connected in parallel with both terminals of the light-emitting diode D252, a phototransistor Q251 of which the emitter is connected to the anode of the light-emitting diode D252 and the collector is connected to a terminal 252, a resistor R253 connected between the collector and the emitter of the phototransistor Q251, a zener diode ZD251 of which the anode is connected to the collector of the phototransistor Q251, and a zener diode ZD252 of which the anode is connected to the cathode of the zener diode ZD251 and the cathode is connected to the emitter of the phototransistor Q251. Moreover, in the indoor side transmitting and receiving section 15, a photocoupler is constructed of a pair of the phototransistor Q251 and a light-emitting diode (not shown), and a photocoupler is constructed of a pair of the light-emitting diode D252 and a phototransistor (not shown), enabling two-way communications. The terminal 251 of the outdoor side transmitting and receiving section 25 is connected to the communication line L3, and the terminal 252 is connected to the transmission power circuit 24.

The diode D251 prevents the current from flowing backward, and the resistor R251 limits the current that flows through the phototransistor Q251 and the light-emitting diode D252. The resistor R252 prevents an overvoltage from being applied across both terminals of the light-emitting diode D252, and the resistor R253 prevents an overcurrent from flowing through the phototransistor Q251.

Figure 4:
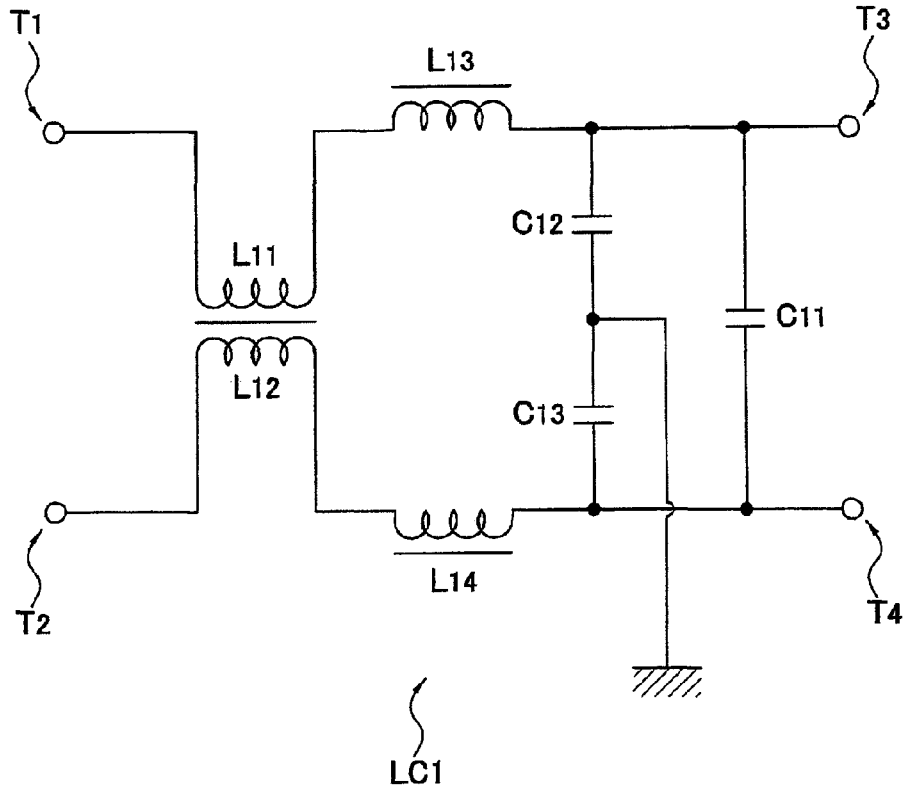
FIG. 4 is a circuit diagram of an EMI filter of an outdoor unit of the air conditioner.

FIG. 4 shows a circuit diagram of the EMI filter LC1 of the outdoor unit of the air conditioner. As shown in FIG. 4, the EMI filter LC1 has a coil L11 that has one terminal connected to a terminal T1, a coil L12 that has one terminal connected to a terminal T2 and forms a mutual inductance with the coil L11, a coil L13 that has one terminal connected to the other terminal of the coil L11 and has the other terminal connected to a terminal T3, a coil L14 that has one terminal connected to the other terminal of the coil L12 and has the other terminal connected to a terminal T4, a capacitor C12 that has one terminal connected to the other terminal of the coil L13 and has the other terminal grounded, a capacitor C13 that has one terminal connected to the other terminal the coil L14 and has the other terminal connected to the other terminal of the capacitor C12, and a capacitor C11 connected between the terminal T3 and the terminal T4.

The terminal T1 of the EMI filter LC1 is connected to the power line L1 (shown in FIG. 1), and the terminal T2 is connected to the power line L2 (shown in FIG. 1). The terminal T3 is connected to the relays MRM10 and MRM20 (shown in FIG. 1), and the terminal T4 is connected to the switching power circuit 22 and MRM11 (shown in FIG. 1).

In the EMI filter LC1, a first noise generated in the power circuit 23 (shown in FIG. 1) is inputted to the terminal T3 via the power line L1 (shown in FIG. 1) and inputted to the terminal T4 via the power line L2 (shown in FIG. 1). The first noise has mainly a low-frequency normal-mode noise and a high-frequency common-mode noise. The low-frequency normal-mode noise has its frequency components of not lower than the cutoff frequency removed by the operation of a low-pass filter constructed of the capacitor C11, the coil L13 and the coil L14. On the other hand, the high-frequency common-mode noise has its frequency components of not lower than the cutoff frequency removed by the operation of a low-pass filter constructed of the capacitor C12, the capacitor C13, the coil L11 and the coil L12.

As shown in FIG. 1, with regard to the relay MR10 of the indoor unit 10, the relay MR10 is closed by an indoor microcomputer 12 when the operation is switched over from the standby state to the operating state, so that the main power is supplied from the power line L1 to the signal line L3. That is, a rise in the voltage of the signal line L3 serves as a signal of switchover from the standby state to the operating state.

Figure 9A:
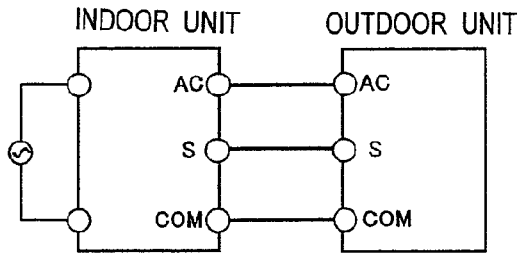
FIG. 9A is a connection diagram for explaining correct wiring of the air conditioner.
Figure 9B:
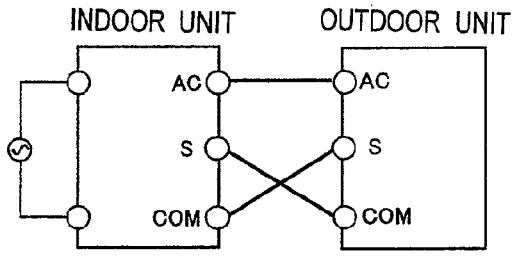
FIG. 9B is a connection diagram for explaining miswiring of the air conditioner.
Figure 9C:
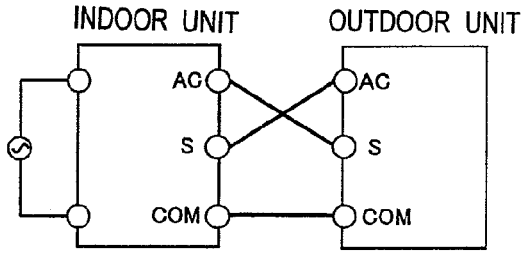
FIG. 9C is a connection diagram for explaining miswiring of the air conditioner.
Figure 9D:
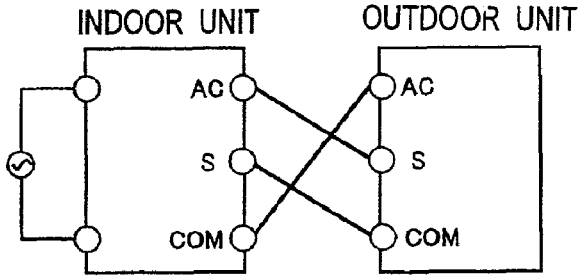
FIG. 9D is a connection diagram for explaining miswiring of the air conditioner.
Figure 9E:
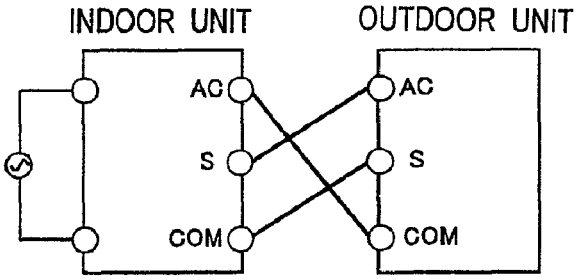
FIG. 9E is a connection diagram for explaining miswiring of the air conditioner.
Figure 9F:
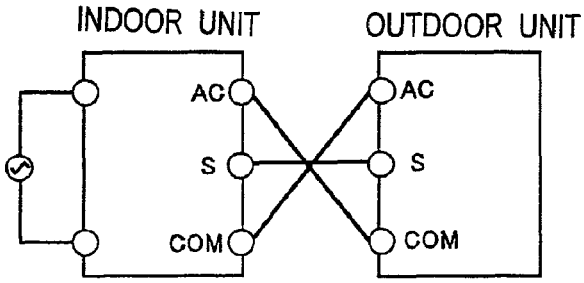
FIG. 9F is a connection diagram for explaining miswiring of the air conditioner.

In the air conditioner of the above construction, it is correct to connect the wiring lines L1 through L3 at the time of installation in a manner that the terminals AC, terminals S and terminals COM of the indoor unit 10 and outdoor unit 20 are mutually connected as shown in FIGS. 1 and 9A. However, five misconnection cases shown in FIGS. 9B through 9F are possible. Among others, in the case of the misconnection shown in FIG. 9B, when the relay MR10 is turned on as indicated by the dashed lines in FIG. 5B, a closed circuit including the external power source 30 is formed to damage the components (for example, the relay MR10). In the misconnection cases of FIGS. 9C through 9F, no closed circuit including the power source is formed, and the components are not damaged.

Accordingly, in the air conditioner of the first embodiment, the indoor control section 12 determines whether or not the connection wiring lines L1 through L3 that connect the indoor unit 10 with the outdoor unit 20 are miswired on the basis of a reception output of the indoor side transmitting and receiving section 15 when the operation starts from the standby state, and does not turn on the relay MRM10 when determining that the wiring lines are miswired.

Figure 6:
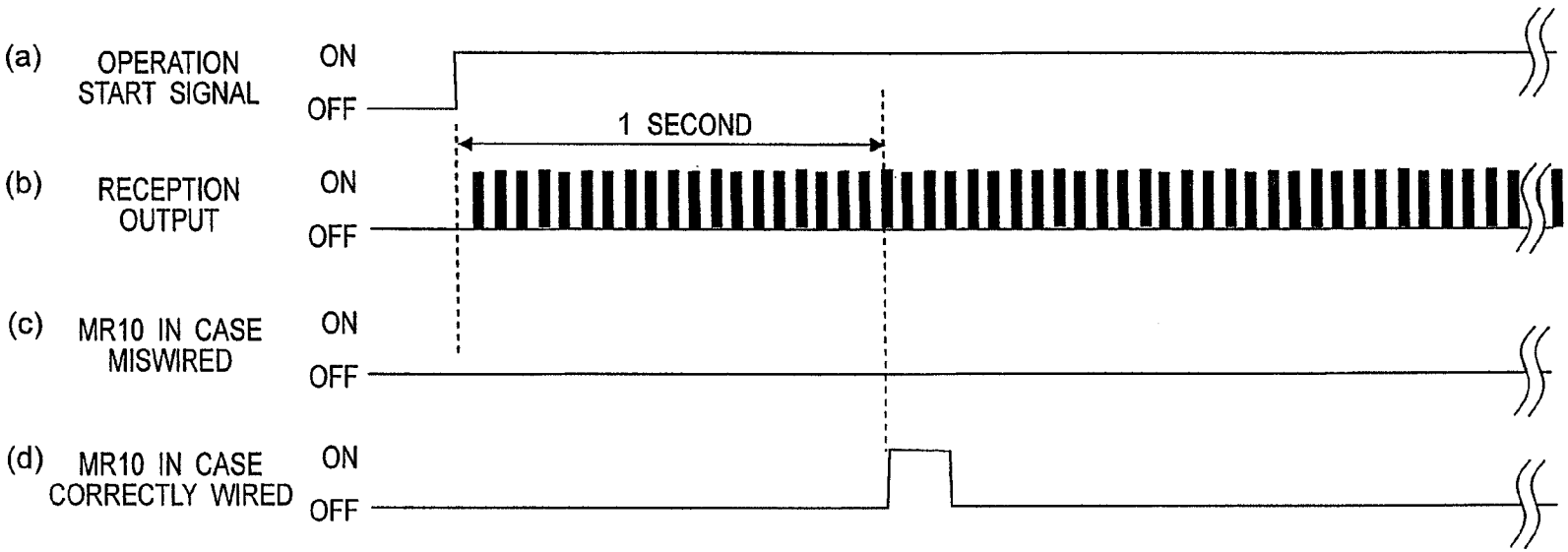
FIG. 6 is a timing chart showing processing when the air conditioner starts operating from a standby state.

FIG. 6 shows a timing chart for explaining the processing when the operation starts from the standby state of the air conditioner. Referring to FIG. 6, FIG. 6(*a*) shows an operation start signal of the air conditioner, FIG. 6(*b*) shows the reception output of the indoor side transmitting and receiving section 15, FIG. 6(*c*) shows the operating state of the relay MR10 in the case of miswiring, and FIG. 6(*d*) shows the operating state of the relay MR10 when the wiring is correct.

Figure 5A:
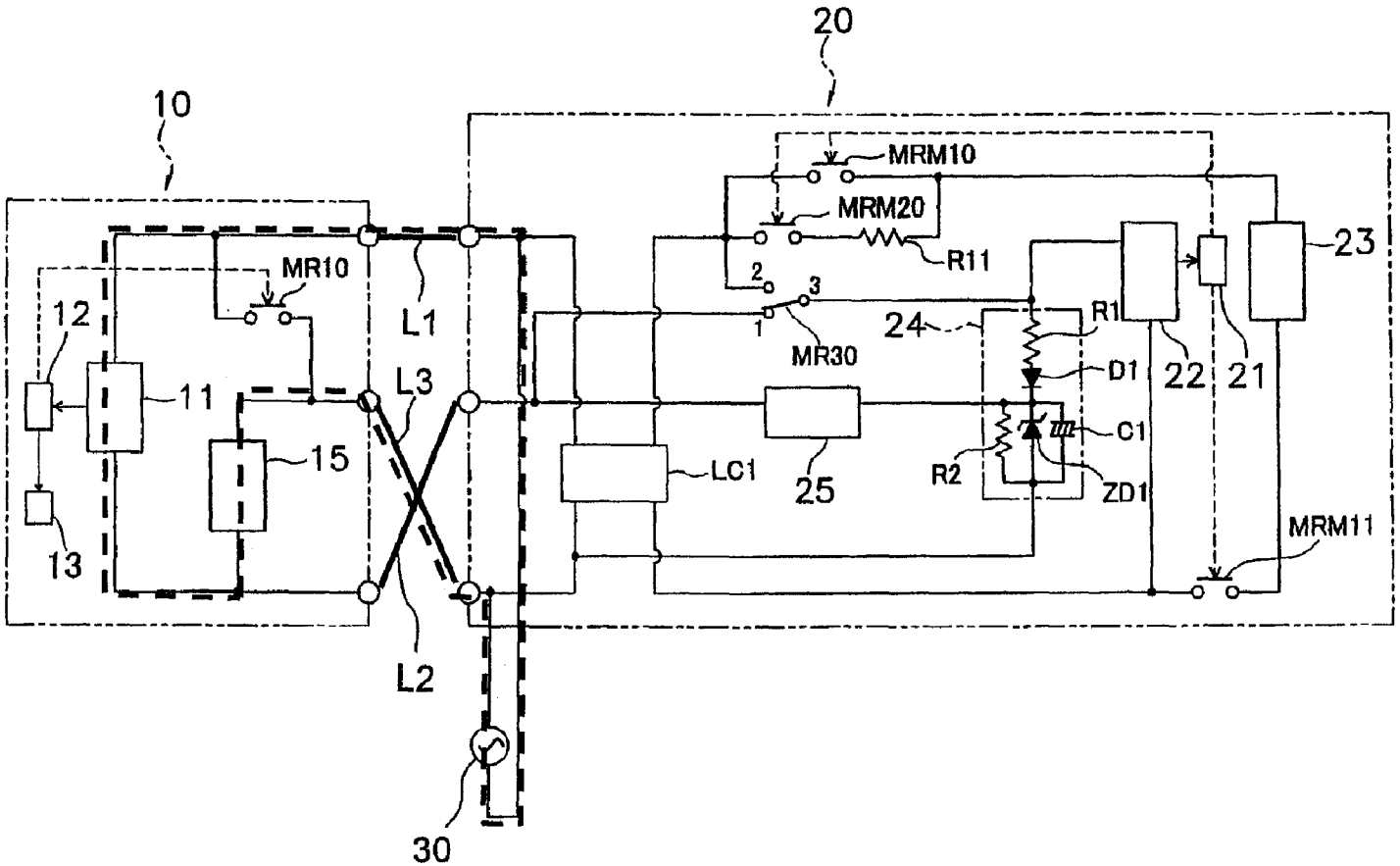
FIG. 5A is a connection diagram in a case of miswiring of the air conditioner.
Figure 5B:
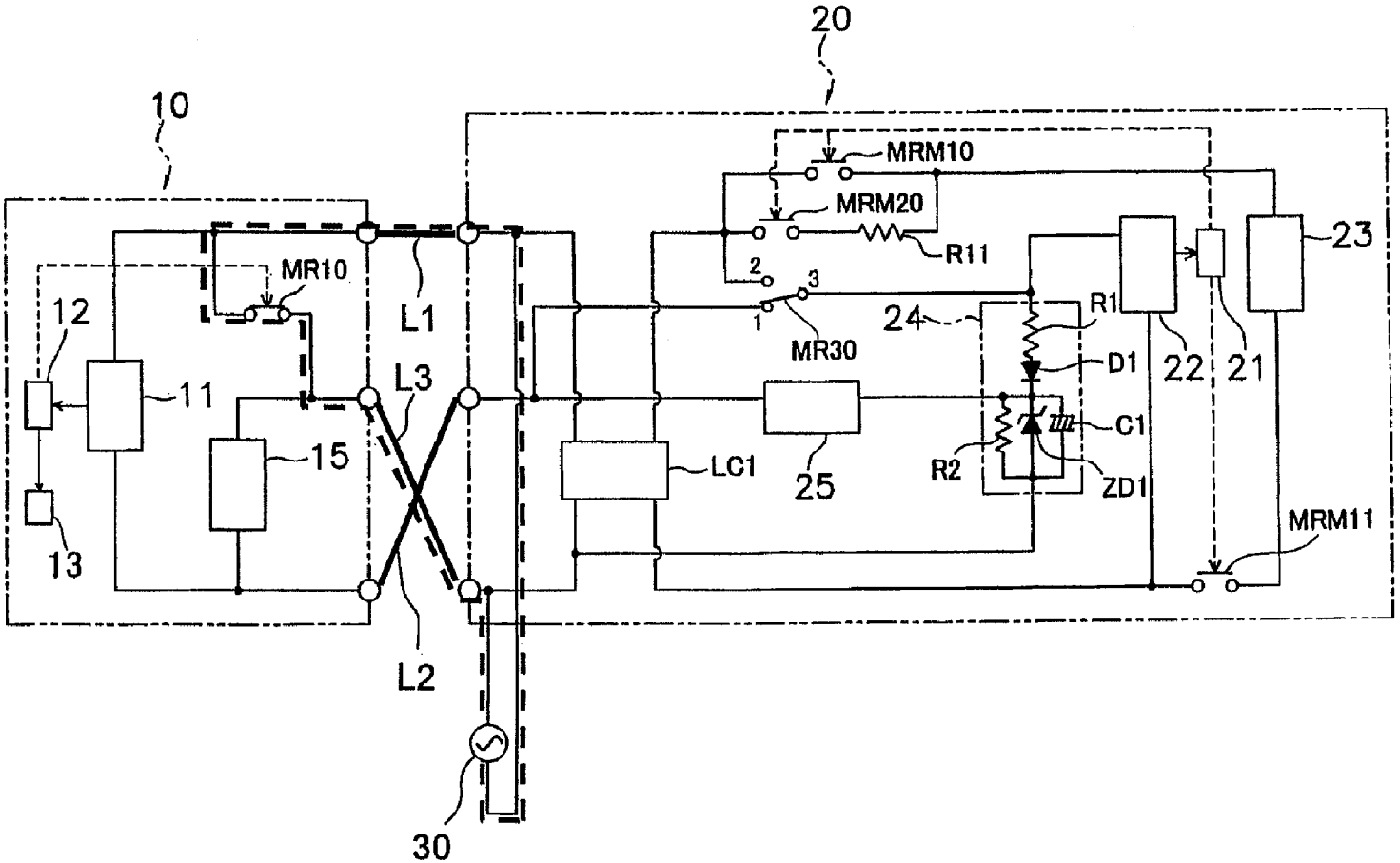
FIG. 5B is a diagram showing a state when a MR10 is turned on in the case of miswiring of the air conditioner.

As shown in FIG. 6, when the operation is first started by manipulating a remote controller (not shown) of the indoor unit 10 in the standby state (during operation stop), the indoor control section 12 receives an operation start signal (shown in FIG. 6(*a*)) and thereafter confirms the reception output of the indoor side transmitting and receiving section 15 after a lapse of a prescribed time (e.g., one second). At this time, if the connection wiring lines are miswired as shown in FIGS. 5A and 5B, the reception output of the indoor side transmitting and receiving section 15 periodically repeats on- and off-states as shown in FIG. 6(*b*). This is because an AC voltage is applied to the connection wiring line L3 with a closed circuit formed as shown in FIG. 5A so that the diode D151 of the indoor side transmitting and receiving section 15 emits light every half wave (at intervals of 20 milliseconds at a frequency of 50 Hz) of the AC voltage.

The indoor control section 12 confirms the reception output of the indoor side transmitting and receiving section 15 in cycles of several milliseconds and does not turn on the relay MR10 upon determining that the wiring lines are miswired when high level consecutively appears two times as shown in FIG. 6(*c*). When the wiring lines are correctly wired, the indoor control section 12 determines that the wiring lines are not miswired since the reception output of the indoor side transmitting and receiving section 15 is not turned on unless communication is carried out, and turns on the relay MR10 for a prescribed time (e.g., several tens of milliseconds) as shown in FIG. 6(*d*).

Upon determining that the wiring lines are miswired on the basis of the reception output of the indoor side transmitting and receiving section 15, the indoor control section 12 informs the user of the miswiring by means of the display section 13.

According to the air conditioner of the first embodiment, damage of the components can be prevented with a simple construction even if the operation starts in the state in which the connection wiring lines (L1 through L3) that connect the indoor unit 10 with the outdoor unit 20 are miswired.

Moreover, it becomes possible to easily determine that the connection wiring lines (L1 through L3) are miswired before the relay MR10 is turned on by the fact that the reception output of the indoor side transmitting and receiving section 15 is turned on as a consequence of applying the power voltage to the signal line L3 in the miswired state shown in FIG. 5A.

Moreover, since the user is informed of the miswiring by the display section 13 when the indoor control section 12 determines that the connection wiring lines (L1 through L3) are miswired, the operator is able to perceive the cause of the trouble at the time of installation and to swiftly cope with the trouble.

(Second Embodiment)

Figure 7:
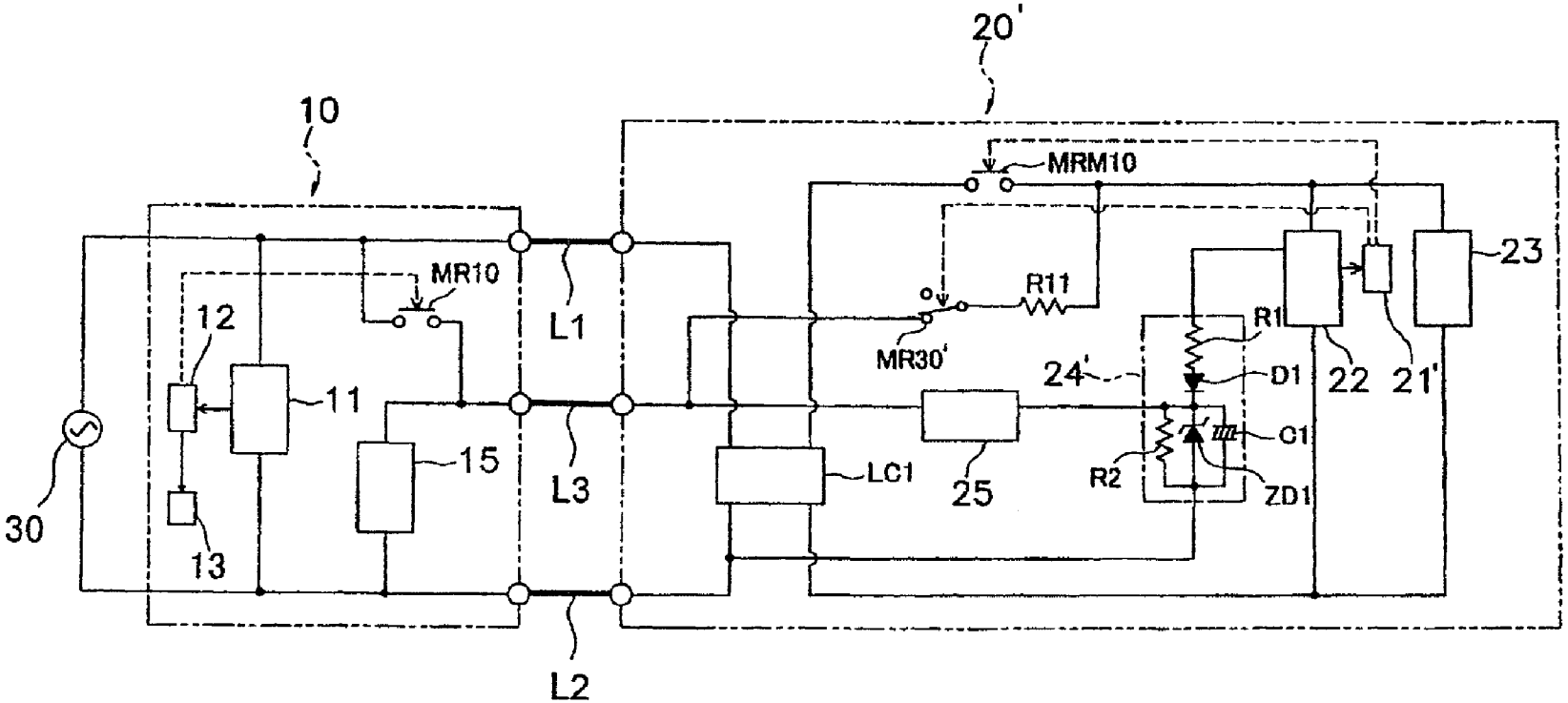
FIG. 7 is a block diagram of an air conditioner according to a second embodiment of the present invention.

FIG. 7 is a block diagram of the air conditioner of the second embodiment of the present invention, showing an indoor unit 10, an outdoor unit 20' connected to the indoor unit 10 via connection wiring lines (L1 through L3), and an external power source 30 connected to the indoor unit 10.

The indoor unit 10 includes a power circuit 11 that has one terminal connected to a power line L1 and has the other terminal connected to a power line L2, an indoor side transmitting and receiving section 15 as one example of the indoor side transmitting and receiving means that has one terminal connected to one terminal of a signal line L3 and has the other terminal connected to the power line L2, and a relay MR10 as one example of the indoor side switch means that is normally in an open state and connected between the power line L1 and the signal line L3. A power voltage supplied from the external power source 30 is applied across both terminals of the power circuit 11. The indoor unit 10 also includes an indoor control section 12 as one example of the indoor control means that is supplied with a power from a power circuit 11 and controls the relay MR10 and so on, and a display section 13 as one example of the informing means controlled by the indoor control section 12.

On the other hand, the outdoor unit 20' includes an EMI filter LC1 that have input terminals connected to the power lines L1 and L2, an outdoor side transmitting and receiving section 25 as one example of the outdoor side transmitting and receiving means connected to the other terminal of the signal line L3, a transmission power circuit 24' that supplies a power to the outdoor side transmitting and receiving section 25, a switching power circuit 22 connected to one terminal of the output terminals of the EMI filter LC1 via a relay MRM10 as one example of the operating power supply switch means, and a power circuit 23 as one example of the load that has one terminal connected to one terminal of the switching power circuit 22. One terminal of a switchover relay MR30' as one example of the startup power supply switch means is connected to the signal line L3, and the other terminal of the switchover relay MR30' is connected to one terminal of the resistor R11. The other terminal of the resistor R11 is connected to a connection point of the relay MRM10 and the switching power circuit 22. Moreover, the other terminal of the switching power circuit 22 and the other terminal of the power circuit 23 are connected to the other terminal of the output terminals of the EMI filter LC1. The outdoor unit 20' also includes an outdoor control section 21' as one example of the outdoor control means that is supplied with a power from the switching power circuit 22 and controls the relay MRM10 and so on.

The indoor side transmitting and receiving section 15, the transmission power circuit 24', the outdoor side transmitting and receiving section 25 and the EMI filter LC1 have identical structures as those of the air conditioner of the first embodiment, and no description is provided for them.

The indoor side transmitting and receiving section 15, the transmission power circuit 24, the outdoor side transmitting and receiving section 25 and the EMI filter LC1 have identical structures as those of the air conditioner of the first embodiment, and no description is provided for them.

Figure 8:
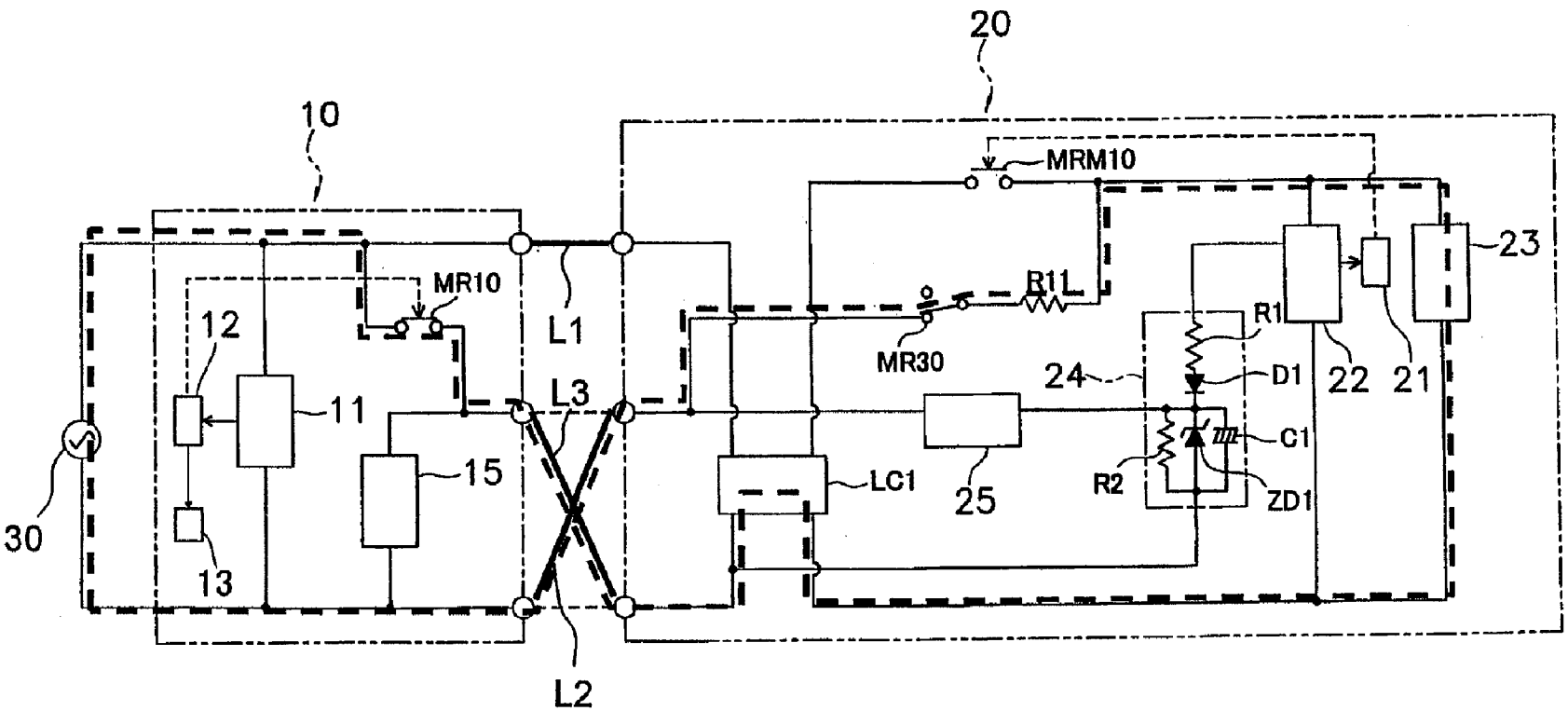
FIG. 8 is a connection diagram in a case of miswiring of the air conditioner.

As shown in FIG. 8, with regard to the relay MR10 of the indoor unit 10, the relay MR10 is closed by an indoor microcomputer 12 when the operation is switched over from the standby state to the operating state, so that the main power is supplied from the power line L1 to the signal line L3. That is, the structure is similar to that of the first embodiment in the point that the signal representing switchover from the standby state to the operating state is a rise in the voltage of the signal line L3.

In the air conditioner of the above construction, it is correct to connect the wiring lines L1 through L3 at the time of installation in a manner that the terminals AC, the terminals S and the terminals COM are mutually connected as shown in FIGS. 7 and 9A. However, five misconnection cases shown in FIGS. 9B through 9F are possible. Among others, in the case of the misconnection shown in FIG. 9B, the components are to be damaged.

Accordingly, in the air conditioner of the second embodiment, the outdoor control section 21' brings the startup relay MR30' into the open state and thereafter turns on the relay MRM10 after a lapse of a prescribed time (e.g., several tens of milliseconds) when the operation starts from the standby state upon supplying a power for startup from the indoor unit 10 side via the signal line L3 by turning on the relay MR10 of the indoor unit 10.

In detail, when the relay MR10 of the indoor unit 10 is turned on, an AC voltage is applied to the signal line L3, so that a power is supplied to the switching power circuit 22 via the switchover relay MR30' and the resistor R11 of the outdoor unit 20. Then, a DC voltage is outputted from the switching power circuit 22 to the transmission power circuit 24 and the outdoor control section 21'. As a result, the outdoor control section 21' that operates upon receiving the DC voltage from the switching power circuit 22 brings the startup relay MR30' into the open state and thereafter turns on the relay MRM10 before the DC voltage output of the switching power circuit 22 is spent and after a lapse of a prescribed time (e.g., several tens of milliseconds). By so doing, the power for operation from the indoor unit 10 side is supplied to the switching power circuit 22 and the power circuit 23 via the power lines L1 and L2.

According to the air conditioner of the second embodiment, damage of the components can be prevented with a simple construction even if the operation starts in the state in which the connection wiring lines (L1 through L3) that connect the indoor unit 10 with the outdoor unit 20' are miswired.

Moreover, when no communication with the outdoor side transmitting and receiving section 25 can be achieved by the indoor side transmitting and receiving section 15 after the relay MR10 is turned on, the indoor control section 12 determines that the connection wiring lines (L1 through L3) are miswired and informs the user of the miswiring by means of the display section 13. Therefore, the operator is able to perceive the cause of trouble at the time of installation and to swiftly cope with the trouble.

Although the external power source 30 is connected to the indoor unit 10 in the second embodiment, the external power source may be connected to the outdoor unit.

Moreover, although the display section 13 is employed as the informing means in the first and second embodiments, the informing means is not limited to this and allowed to give information by means of a voice sound or a buzzer sound.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An air conditioner comprising:

an indoor unit and an outdoor unit which are connected via connection wiring;

the connection wiring comprising two power lines for supplying a power from an external power source via one of the indoor unit and the outdoor unit to the other of the indoor unit and the outdoor unit, and one signal line for carrying out communication between the indoor unit and the outdoor unit;

the indoor unit comprising an indoor side switch device which is connected between one of the power lines and the signal line and brought into a closed state at a startup time when operation starts from a standby state in which the supply of power of the outdoor unit is stopped, and the outdoor unit comprising:

a startup power supply switch device which is brought into a closed state so that a power for startup is supplied from the indoor unit side via the signal line when the indoor side switch device of the indoor unit is brought into the closed state, an operating power supply switch device which is brought into a closed state so that the power for operation is supplied to a load via the power line in operation, and is brought into an open state in the standby state, and an outdoor control device which controls the operating power supply switch device and the startup power supply switch device, wherein the outdoor control device of the outdoor unit brings the startup power supply switch device into the open state when the operation starts from the standby state by supplying a power for startup from the indoor unit side via the signal line and the startup power supply switch device, said power being supplied from the indoor unit side as a consequence that the indoor side switch device of the indoor unit is brought into the closed state, and after the startup power supply switch is brought into the open state, the outdoor control device brings the operating power supply switch device into the closed state after a lapse of a prescribed time.

2. The air conditioner as claimed in claim 1, wherein the indoor unit comprises an indoor side transmitting and receiving device connected to the signal line; an indoor control device which controls the indoor side switch device and the indoor side transmitting and receiving device, and an informing device for informing a user of miswiring, the outdoor unit comprises an outdoor side transmitting and receiving device which is connected to the signal line and carries out communication with the indoor side transmitting and receiving device, the indoor control device determines that the connection wiring lines which connect the indoor unit with the outdoor unit are miswired when, after bringing the indoor side switch device into the closed state to start operation from the standby state, no communication with the outdoor side transmitting and receiving device can be achieved by the indoor side transmitting and receiving device, and the indoor control device informs the user of miswiring by the informing device when the determination indicates that the connection wiring lines are miswired.

* * * * *